US007059396B2

(12) United States Patent
Foli

(10) Patent No.: US 7,059,396 B2
(45) Date of Patent: Jun. 13, 2006

(54) SYSTEM FOR CONFIGURING THE GEOMETRIC PARAMETERS FOR A MICRO CHANNEL HEAT EXCHANGER AND MICRO CHANNEL HEAT EXCHANGERS CONFIGURED THEREBY

(75) Inventor: Augustine Kwasi Foli, Powell, OH (US)

(73) Assignee: Honda Motor Co., Ltd., Tokyo (JP)

( * ) Notice: Subject to any disclaimer, the term of this patent is extended or adjusted under 35 U.S.C. 154(b) by 98 days.

(21) Appl. No.: 10/666,263

(22) Filed: Sep. 17, 2003

(65) Prior Publication Data

US 2005/0056409 A1 Mar. 17, 2005

(51) Int. Cl.
*F28F 7/02* (2006.01)

(52) U.S. Cl. ..... 165/164; 165/177; 165/185; 165/80.3

(58) Field of Classification Search ..... 165/164, 165/177, 80.1–80.5, 185; 257/713, 714
See application file for complete search history.

(56) References Cited

U.S. PATENT DOCUMENTS 4,516,632 A * 5/1985 Swift et al. ..... 165/167
4,894,709 A * 1/1990 Phillips et al. ..... 257/714
5,372,188 A * 12/1994 Dudley et al. ..... 165/110
5,771,964 A * 6/1998 Bae ..... 165/177
6,415,860 B1 * 7/2002 Kelly et al. ..... 165/164
6,622,519 B1 * 9/2003 Mathias et al. ..... 62/611
6,865,081 B1 * 3/2005 Meyer et al. ..... 257/714
2003/0027022 A1 * 2/2003 Arana et al. ..... 429/17
2003/0178188 A1 * 9/2003 Coleman ..... 165/164
2005/0087767 A1 * 4/2005 Fitzgerald et al. ..... 257/200

OTHER PUBLICATIONS

"Comparative Studies on Micro Heat Exchanger Optimisation", Okabe et al, The 2003 Congress on Evolutionary Computation, vol. 1, pp. 647-654, Dec. 2003.*
"Optimization of conduits' shape in micro heat exchangers", Haim H. Bau, International Journal of heat and Mass Tranfer 41 (1998) 2717-2723.*
"Optimum Design of Microchannel heat sinks", Choquette et al, DSC0vol. 59, Microelectromechanical Systems (MEMS) ASME, pp. 115-126, 1996.*
"Manifold Microchannel Heat Sinks: Theory and Experiment", Copeland et al, EEP-vol. 10-2, Advances in Electronic Packaging ASME, pp. 829-835, 1995.*

(Continued)

*Primary Examiner*—Teresa J. Walberg
(74) *Attorney, Agent, or Firm*—Mark E. Duell, Esq.; Porter Wright Morris & Arthur LLP

(57) ABSTRACT

Geometric parameters of micro channel aspect ratios are determined for heat exchangers for gaseous fluids in which micro channels have a surface area density greater than 10000 $m^2/m^3$ in the alternate situations a) where volume is constant, and b) where volume is variable. Computational fluid dynamics and an analytical approach are combined under given constraints to optimize micro channel aspect ratio and micro channel spacing using plots of the performance curves of pressure loss in the channel for the hot side; pressure loss in the channel for the cold side; heat flux; and heat transfer rate.

12 Claims, 12 Drawing Sheets

OTHER PUBLICATIONS

"Thermal-Hydraulic performance of small scale Micro-channel and porous-media heat-exchangers", Jiang et al, Internation Journal of Heat and Mass Transfer, 44 (2001), pp. 1039-1051, 2001.*

"Microchannel heat exchangers— a review", John Goodling, SPIE vol. 1997 Hich Heat Flux Engineering II (1993) , pp. 66-82, 1993.*

* cited by examiner

SYSTEM FOR CONFIGURING THE GEOMETRIC PARAMETERS FOR A MICRO CHANNEL HEAT EXCHANGER AND MICRO CHANNEL HEAT EXCHANGERS CONFIGURED THEREBY

FIELD OF THE INVENTION

The present invention relates to micro channel heat exchangers configured in accordance with a system and/or method applying computational fluid dynamics and analytical techniques to determine geometric parameters of micro channels to enhance the efficiency of a heat exchanger in a given application for which an operating environment is specified.

BACKGROUND AND SUMMARY OF THE INVENTION

Micro channels are used in heat exchangers and applications in medicine, consumer electronics, avionics, metrology, robotics, industry processes, telecommunications, automotive and other areas. The thermal performance of a micro channel depends on the geometric parameters and flow conditions defining the micro channel environment. Prior art attempts using analytical or numerical techniques to determine the optimal dimensions of micro channels assume that the aspect ratio of the micro channels is known a priori. The present invention determines the optimum geometric parameters of micro channels in micro heat exchangers by combining computational fluid dynamics (CFD) analyses and an analytical method of calculating the optimum geometric parameters of micro heat exchangers. CFD is used in determining the optimal aspect ratio and an analytical approximation is employed to calculate optimal micro heat exchanger dimensions based on the determined optimal aspect ratio.

A heat exchanger is referred to as a micro heat exchanger when the surface area density is greater than 10000 $m^2/m^3$ on at least one of the fluid sides. [Shah, R. K., *Compact heat exchanger technology and applications*, in E. A. Foumeny, P. J. Heggs (Ed.), Heat Exchange Engineering, E. Horwood, New York, 1991, chap. 1.] Micro channel heat exchangers combine the attributes of a high surface area to volume ratio, a large convective heat transfer coefficient, and small mass and volume. Early work proposed micro channel heat sinks based on the idea that the heat transfer coefficient is inversely proportional to the hydraulic diameter of the channel. [D. B. Tuckerman, R. F. W. Pease, *High-performance heat sinking for VSLI*, IEEE Electron Dev. 2 (1981) 126–129]. High heat transfer coefficients are achievable with small hydraulic diameters since the heat transfer coefficient is inversely proportional to the hydraulic diameter; thus, micro channels have high heat flux capacity.

In micro channels: 1) a small cross-sectional area of a micro channel reduces the thickness of a thermal and hydraulic boundary layers; the resultant effect is that the heat transfer coefficient, h, is several times higher than the thermal conductance of a stationary layer; 2) the heat transfer coefficient is higher in the thermally developing region where the thermal boundary layer is thin; in micro channels most, if not all, of the micro channel is in the thermally developing region where h is high; 3) micro channel passages have sharp-edge entrances; pre-turbulence at the sharp-edged inlets delays development of the thermal boundary resulting in thinner thermal boundary layer, and hence, a higher heat transfer coefficient; and 4) as a result of the small scale of micro channel passages, wall roughness plays an important role in increasing the heat transfer coefficient.

A disadvantage of the micro channel as a fluid flow device is the high pressure loss associated with a small hydraulic diameter. In order to take maximum advantage of the micro channel, there must be a balance between the desirable high heat transfer coefficient and the undesirable pressure loss.

Experimental, analytical and numerical studies have referred to deviations in the heat transfer and fluid flow characteristics of micro-scale devices from those of conventionally-sized (or macro-scale) devices. Flow and heat transfer characteristics of fluids flowing in micro channels could not be adequately predicted by theories and correlations developed for conventionally-sized channels. For example, studies showed that the performance of a micro channel heat exchanger depends very much on the aspect ratio (AR) of the channels. [J. B. Aparecido, R. M. Cotta, *Thermally developing laminar flow inside rectangular ducts*, Int. J. Heat Mass Transfer 33 (2) (1990) 341–347, and X. Wei, Y. Joshi, *Optimization of stacked micro-channel heat sinks for micro-electronic cooling*, Inter Society Conf. On Thermal Phenomena (2002) 441–448.]

Optimization studies to minimize temperature gradient and overall thermal resistance in micro channels suggested that reduction in overall thermal resistance could be achieved by varying the cross-sectional dimensions of a channel. [H. H. Bau, *Optimization of conduits' shape in micro heat exchangers*, Int. J. Heat Mass Transfer 41 (1998) 2117–2723].

Prior attempts to design micro heat exchangers and reactors, for example, in the process and automotive industries, may be classified as analytical and numerical methodologies. In analytical studies, the primary objective is to design schemes to optimize the channel dimensions in micro heat exchangers by maximizing heat transfer for a given pressure drop. In such an optimization scheme, a mathematical description of the transport processes in the micro channel is required; however, the complex heat transfer process in micro channels coupled with the flow makes it practically impossible to solve analytically the conservation equations that describe the fluid flow and heat transfer phenomenon. In most analytical studies, equations are reduced to tractable forms by simplifying assumptions that compromise the accuracy of predictions. To accurately predict fluid flow and heat transfer phenomena in micro channels, a numerical solution of the complete form of the conservation equations must be solved numerically.

Another approach combines computational fluid dynamics numerical simulation (CFD) with an optimization strategy to determine the optimal shape of a micro channel heat sink that minimizes the thermal resistance. [J. H. Ryu, D. H. Choi, S. J. Kim, *Numerical optimization of the thermal performance of a micro channel heat sink*, Int. J. Heat Mass Transfer 45 (2002) 2823–2827]. In this approach, however, the optimal geometric parameters were determined based on an assumed aspect ratio of the micro channels.

It is an object of this invention to provide optimal micro channels in micro heat exchangers that maximize the heat transfer rate (or heat flux) subject to specified design constraints. The invention optimizes the geometric parameters based on an optimal aspect ratio of the micro channels of the micro heat exchanger. Although the examples herein relate to gas flow (nitrogen and carbon dioxide) and an Inconel® micro channel heat exchanger, the methods, systems, and configurations herein similarly apply to other fluids and high-conductivity solids.

The invention is described more fully in the following description of the preferred embodiment considered in view of the drawings in which:

BRIEF DESCRIPTION OF THE SEVERAL VIEWS OF THE DRAWINGS

In FIG. 5A, an optimum region is identified; in FIG. 5B, tangents of plotted curves are intersected; and in FIG. 5C, the methodologies of FIG. 5A and FIG. 5B are adapted to the determination of a range on the aspect ratio axis of the plot.

DETAILED DESCRIPTION OF THE INVENTION

Figure 1:
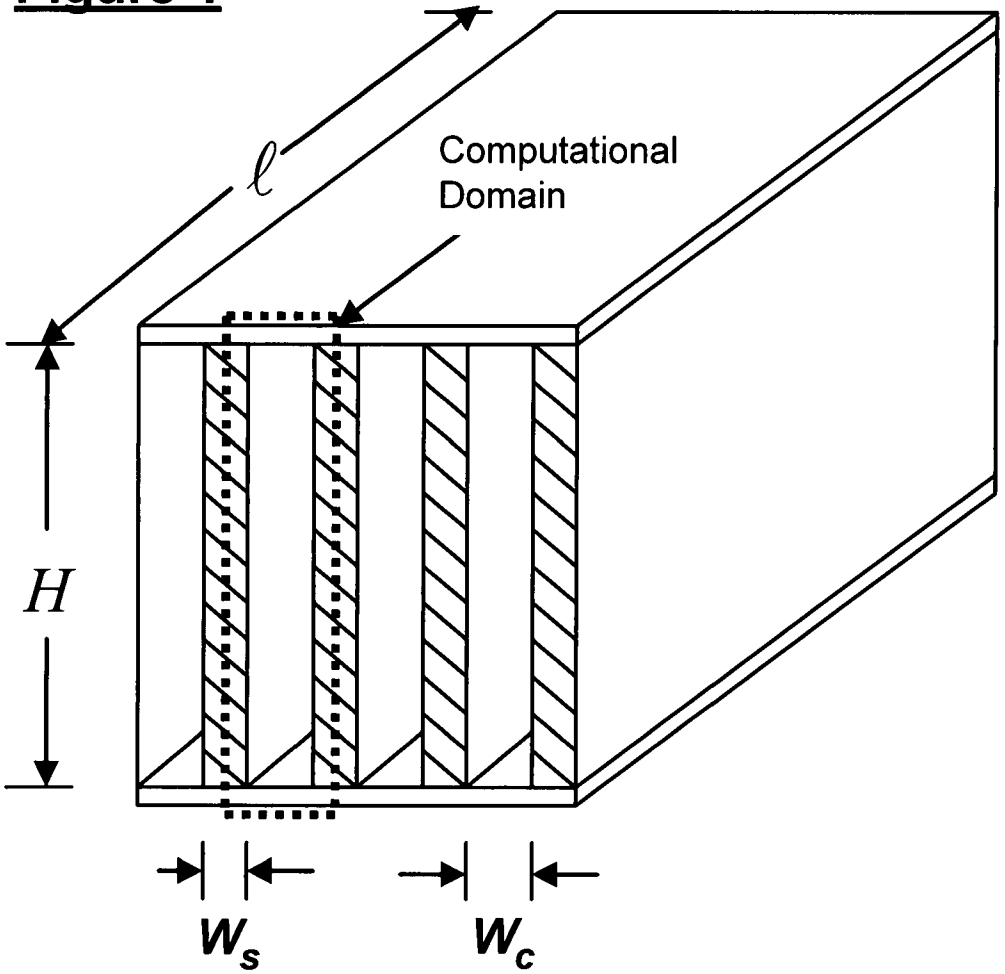
FIG. 1 depicts the geometric computational domain of a typical micro channel.

In brief, geometric parameters of the aspect ratio are determined for channels in a micro heat exchanger for gaseous fluids in which micro channels have a surface area density greater than 10000 $m^2/m^3$ in the alternate situations a) where volume is constant, or b) where volume is variable and i) the given aspect ratio is less than or equal to 10 or ii) the given aspect ratio is more than 10. The separate methodologies of computational fluid dynamics and an analytical approach are combined under given constraints such as pumping power and space limitations and the variables optimized are channel width, aspect ratio and spacing. Based on the problem specification, the optimal geometric parameters of a micro channel are obtained using plots of the performance curves of 1) pressure loss in the channel for the hot side; 2) pressure loss in the channel for the cold side; 3) heat flux; and 4) heat transfer rate—against an axis corresponding to aspect ratio as a basis for a direct determination in the instance of constant volume, or further calculation in the instance of variable volume.

In the description of the invention, the nomenclature below applies:

| | |
|---|---|
| b | Defined length scale |
| $c_p$ | Specific heat capacity at constant pressure |

-continued

| | |
|---|---|
| g | Acceleration due to gravity |
| h | Heat transfer coefficient, specific enthalpy |
| H | Height of micro channels |
| k | Thermal conductivity |
| l | Length of channel |
| Nu | Nusselt number |
| $u_i$ | Velocity component in tensor notation |
| p | Pressure |
| $\Delta P$ | Pressure drop in channel |
| T | Temperature |
| w | Width |
| $\beta$ | Bulk viscosity |
| $\mu$ | Dynamic viscosity |
| $\rho$ | Density |
| c | Channel (subscript) |
| f | Fluid (subscript) |
| s | Solid (subscript) |
| AR | Aspect ratio of a channel, the ratio of the height of a channel to its width, i.e., $AR = \frac{H}{w_c}$. |

The optimal geometric parameters of the channels of a micro heat exchanger are determined by combining the separate methodologies of computational fluid dynamics and an analytical approach. This results in an improvement over known calculation schemes such as described in V. K Samalam, *Convective heat transfer in microchannels*, J. Electronic Materials 18 (5) (1989) 611–617. In the foregoing reference ("Samalam"), the analysis of the micro channel flow problem is reduced to a quasi two-dimensional differential equation that presents exact solutions analytically to determine optimal dimensions of micro channels under given constraints. Under given constraints such as pumping power and space limitations, the variables to be optimized are the channel width, aspect ratio and spacing. In an element of the invention, computational fluid dynamics (CFD) analysis is then used to determine the optimal aspect ratio of micro heat exchanger channels subject to given constraints. Based on the problem specification, the optimal geometric parameters of a micro channel are either directly obtained, based on the determined optimal aspect ratio, or are then calculated by the method described by Samalam.

EXAMPLE I

Forced convection through a micro heat exchanger is addressed in this example. The schematic model of the micro heat exchanger shown in FIG. 1 consists of rectangular channels with hot and cold fluid flowing through alternate channels. The dimensions of the heat exchanger core are shown in the figure. The method described applies to co-flow and counter-flow configurations.

The following assumptions are made with regard to the flow and heat transfer in the micro channels: 1) the hydraulic diameter of micro channels is between 100 μm and 1000 μm. The Knudsen Number for the flows considered is less than 0.001, a condition necessary for the continuum flow assumption. (Conservation equations based on continuum flow therefore apply.); 2) the transport processes are steady; 3) the thermophysical properties of the fluids are temperature dependent; 4) for overall optimal performance of the micro channels, the analyses are restricted to laminar and incompressible flows; and 5) thermal radiation is neglected.

The governing equations that describe flow and heat transfer in the micro heat exchangers are the Navier-Stokes and energy equations based on the continuum flow assumptions. In tensor notations these equations are:

Continuity:

$$\frac{\partial}{\partial x_i}(\rho u_i) = 0$$

Momentum:

$$\rho u_j \frac{\partial u_i}{\partial x_j} = -\frac{\partial p}{\partial x_i} + \rho g_i + \frac{\partial \tau_{ij}}{\partial x_j}$$

where $$\tau_{ij} = \mu\left(\frac{\partial u_i}{\partial x_j} + \frac{\partial u_j}{\partial x_i}\right) + \left(\beta - \frac{2}{3}\mu\right)\frac{\partial u_k}{\partial x_k}\delta_{ij}$$

Energy:

$$\rho u_i \frac{\partial h}{\partial x_i} = \frac{\partial p}{\partial t} + u_i \frac{\partial p}{\partial x_i} + \phi + \frac{\partial}{\partial x_i}\left(k\frac{\partial T}{\partial x_i}\right)$$

where $\phi = \tau_{ij}\frac{\partial u_i}{\partial x_j}$

To predict the thermal performance of the micro heat exchanger, the Navier-Stokes and energy equations were solved in three dimensions with the commercial CFD software, CFD-ACE+. [See CFD-ACE+Theory Manual, (Version 2002) CFD Research Corporation, 215 Wynn Drive, Huntsville, Ala. 35805, 2002].

In solving the transport equations, the mass flow rate and inlet temperature of the fluids entering the channels were specified, while the gradients of the temperature and velocity components at the exit of the channels were set to zero. Adiabatic boundary conditions were imposed on the walls and the continuity of the temperature and heat flux was used as the conjugate boundary conditions to couple the energy equations for the solid and fluid phases. Finally, the no-slip boundary condition was imposed on the velocity components at the wall. In cases where geometric symmetry exists the computational domain is simplified as shown marked in FIG. 1.

Figure 2:
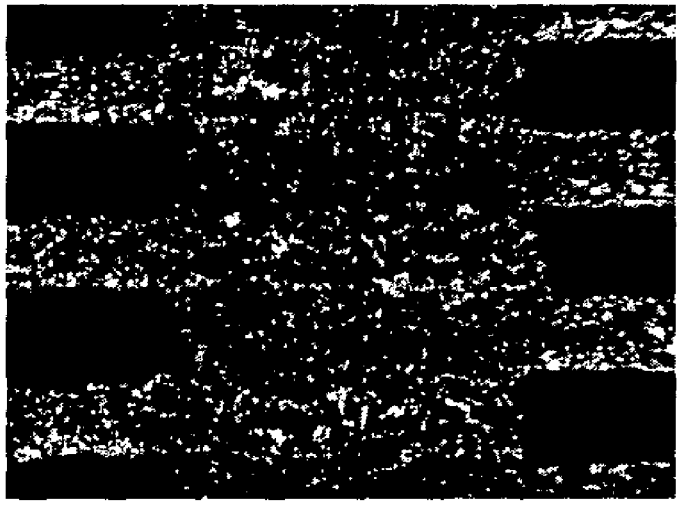
FIG. 2 is a photomicrograph of a cross section through a micro channel heat exchanger.
Figure 3A:
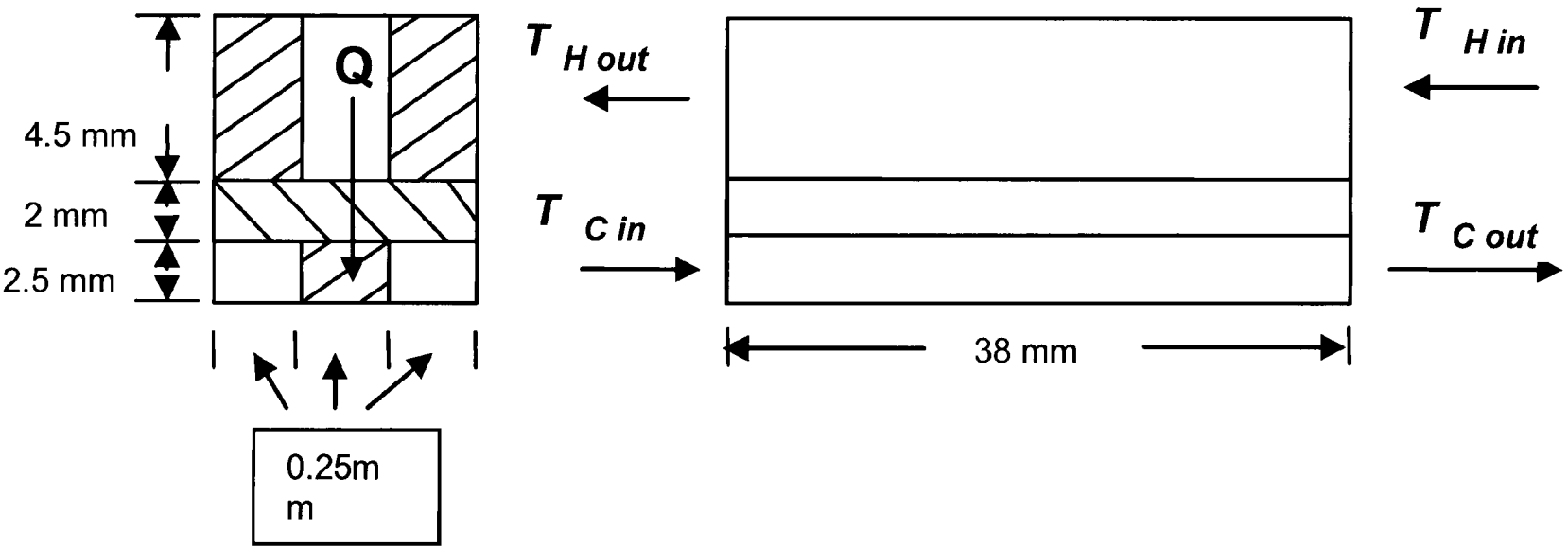
FIG. 3A shows dimensions (not to scale) of a representative micro channel configuration for a heat exchanger.
Figure 3B:
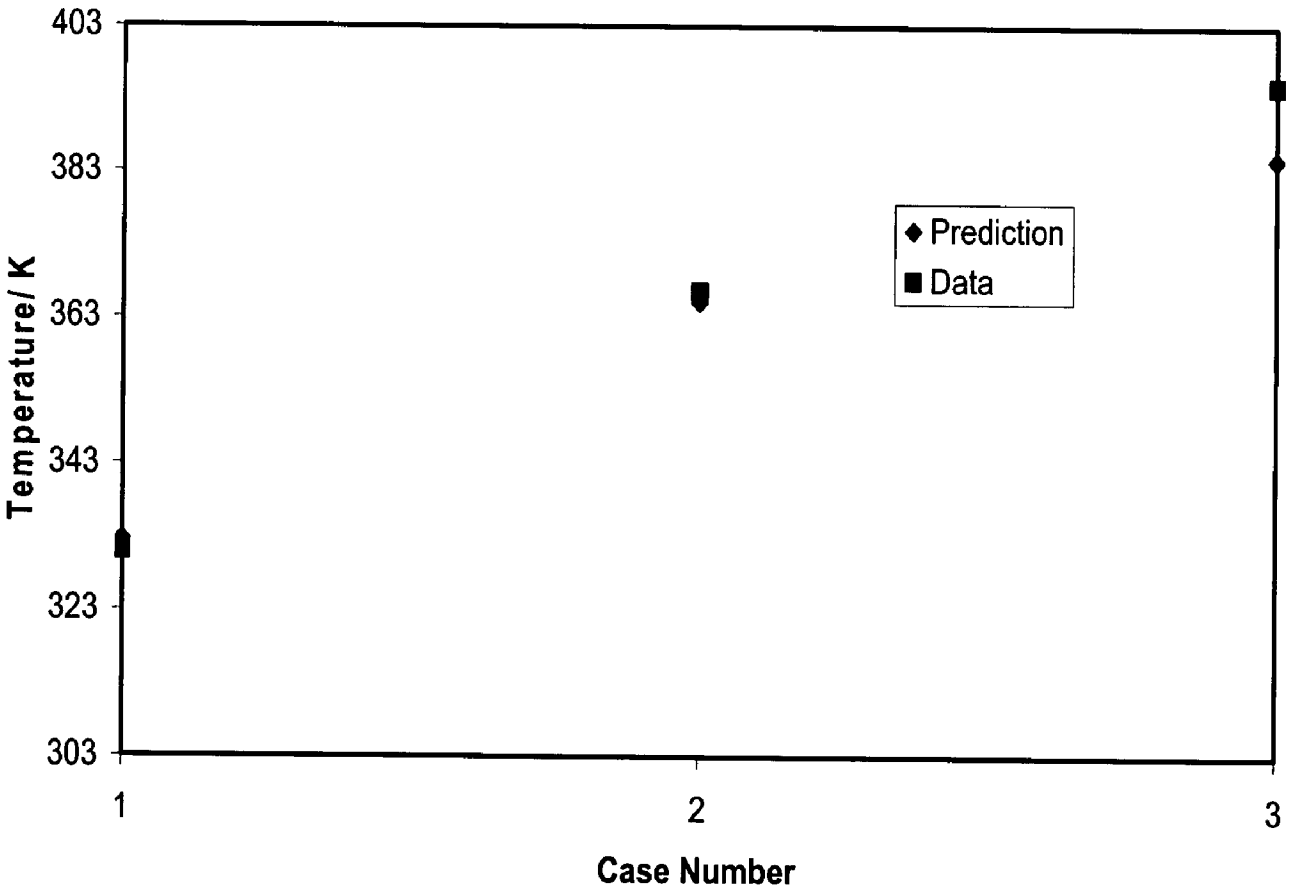
FIG. 3B is a chart comparing predicted and actual values of outlet temperatures of hot gas in a micro channel heat exchanger configured in accordance with the invention.

To validate the numerical procedure for the conjugate heat transfer problem, numerical predictions of the flow and heat transfer through a micro heat exchanger were compared with experimental data. The experimental device was a micro heat exchanger designed by the Pacific Northwest National Laboratories (PNNL). The material of the micro heat exchanger was steel. A cross-section through the heat exchanger is shown in FIG. 2. FIG. 3 shows the dimensions (not to scale) of the micro channels of the heat exchanger. For all test conditions, carbon dioxide, with a total volumetric flow rate of 45 slpm, was used as cold gas and nitrogen, with a total volumetric flow rate of 44 slpm, was used as hot gas. Inlet temperatures of the gases for the three test conditions are shown in Table 1.

Figure 4:
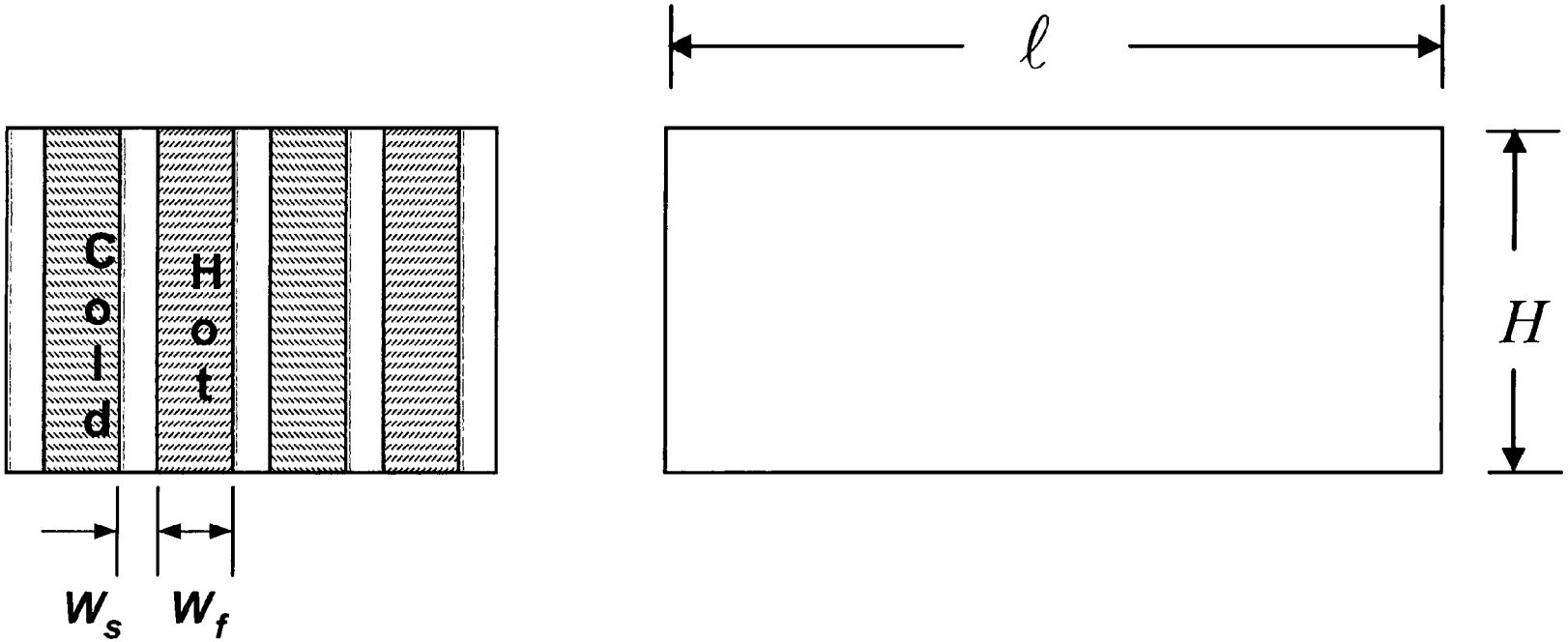
FIG. 4 is a cross section through a micro heat exchanger (not to scale) showing "hot" and "cold" sides.

Results of three-dimensional simulations with grid-independent solutions were compared with experimental data. FIG. 4 shows the comparison between experimental data and the numerical predictions when the heat exchanger was tested in counter flow mode. The results show very good agreement with a maximum deviation of 8.4%. Taking into account uncertainties in measurement, these results confirmed the adequacy of the numerical procedures in the CFD package for the analyses.

TABLE 1

TEST CONDITIONS

| | Case 1 | Case 2 | Case 3 |
|---|---|---|---|
| $N_2$ inlet temperature ($T_{H\text{-}in}$) | 371.7 K | 434 K | 482 K |
| $CO_2$ inlet temperature ($T_{C\text{-}in}$) | 300.8 K | 309.4 K | 316 K |

EXAMPLE II

Though the approach described here applies to regular geometries, the geometry considered for the analyses in Cases 1 and 2 below was a micro channel heat exchanger with rectangular channels as shown in FIG. 4.

The constraints considered in the analyses were: 1) the maximum allowable pressure loss or pumping power; 2) the flow rate of hot and cold fluid; and 3) the parameters to be optimized were channel height, channel width and thickness of solid material between channels.

The first step towards the dimensional/configuration optimization was to determine the thermal performance characteristics of the micro heat exchanger by conservative numerical equations. Two cases were considered: 1) the allowable volume of the heat exchanger as known based on design constraints; this volume would be kept constant; and 2) no limit is placed on the volume of the heat exchanger core; the volume would therefore be varied. For both cases, nitrogen is used as the hot fluid and carbon dioxide as the coolant.

EXAMPLE II A

In this Example II A, the volume of a micro heat exchanger is fixed by design considerations, each micro channel of the heat exchanger was assigned a volume of 50 $mm^3$. Assuming a fixed length of 40 mm for all channels, this resulted in a constant cross-sectional area of 1.25 $mm^2$ for each micro channel. Numerical simulations were performed by varying the aspect ratio of the micro channels in the range $1.25 \leqq AR \leqq 86.8$ whilst maintaining a constant cross-sectional area, in this case, of 1.25 $mm^2$. For a constant cross-sectional area of channel, the aspect ratio was varied by varying both the width, $w_c$, and height, H, of the channels. Table 2 shows the inlet conditions for the aspect ratios considered. Inconel® with a thickness of 0.1 mm was the micro channel material.

TABLE 2

| | Material | Flow rate per μ-channel (kg/sec) | Inlet Temperature (K) | Inlet pressure (bar) |
|---|---|---|---|---|
| Hot Gas | $N_2$ | 1.0e−5 | 1023 | 1.358 |
| Coolant | $CO_2$ | 1.0e−5 | 493 | 1.338 |

Figure 5A:
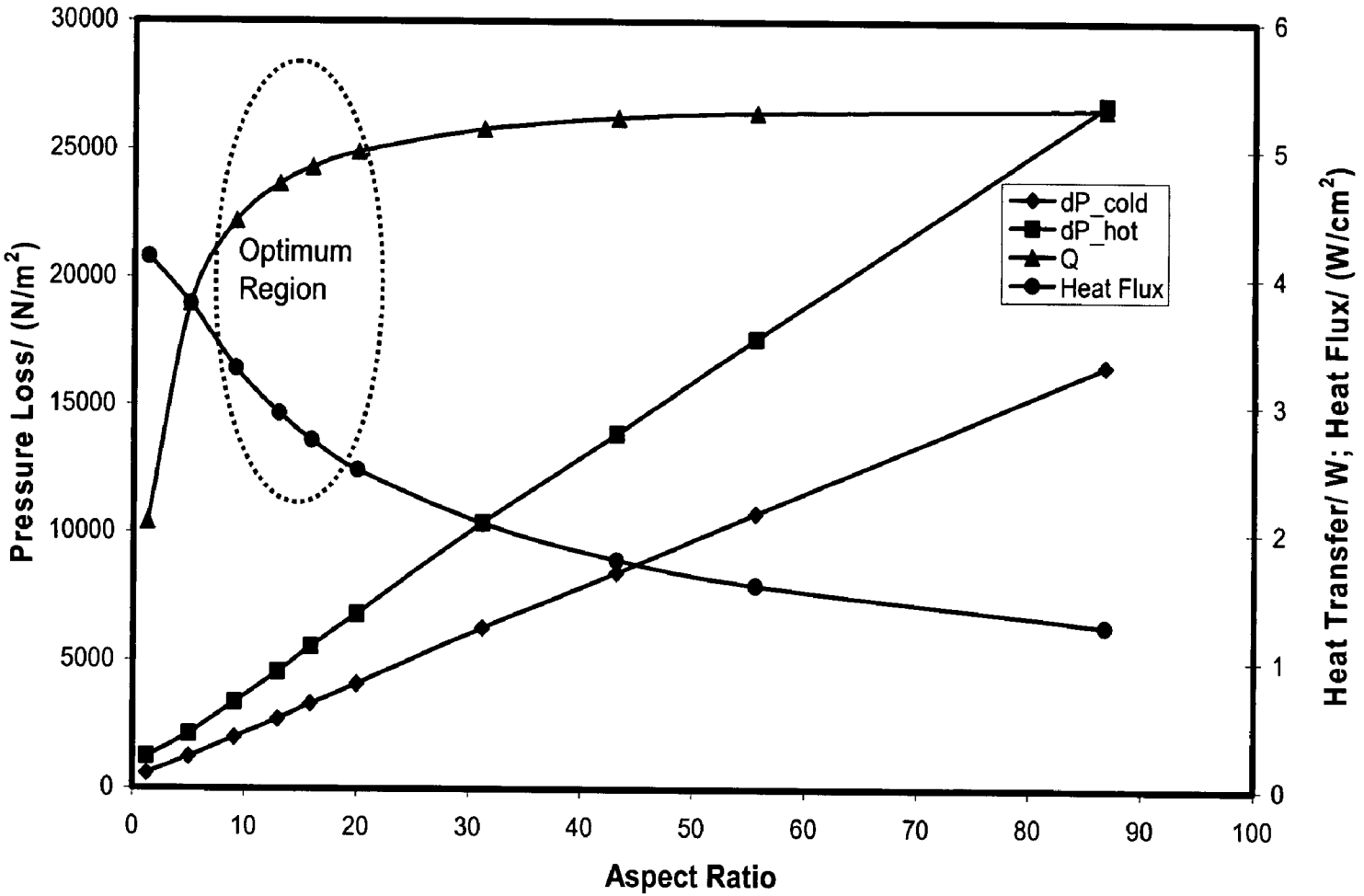
FIG. 5A, FIG. 5B and FIG. 5C are charts showing how, in differing manners with respect to the variations of the calculated curves of pressure loss, heat transfer rate and heat flux (in a given example for constant volume), plotted against channel aspect ratio, an approximation of the optimum range of aspect ratios for a specific situation is identified in accordance with the invention.
Figure 5B:
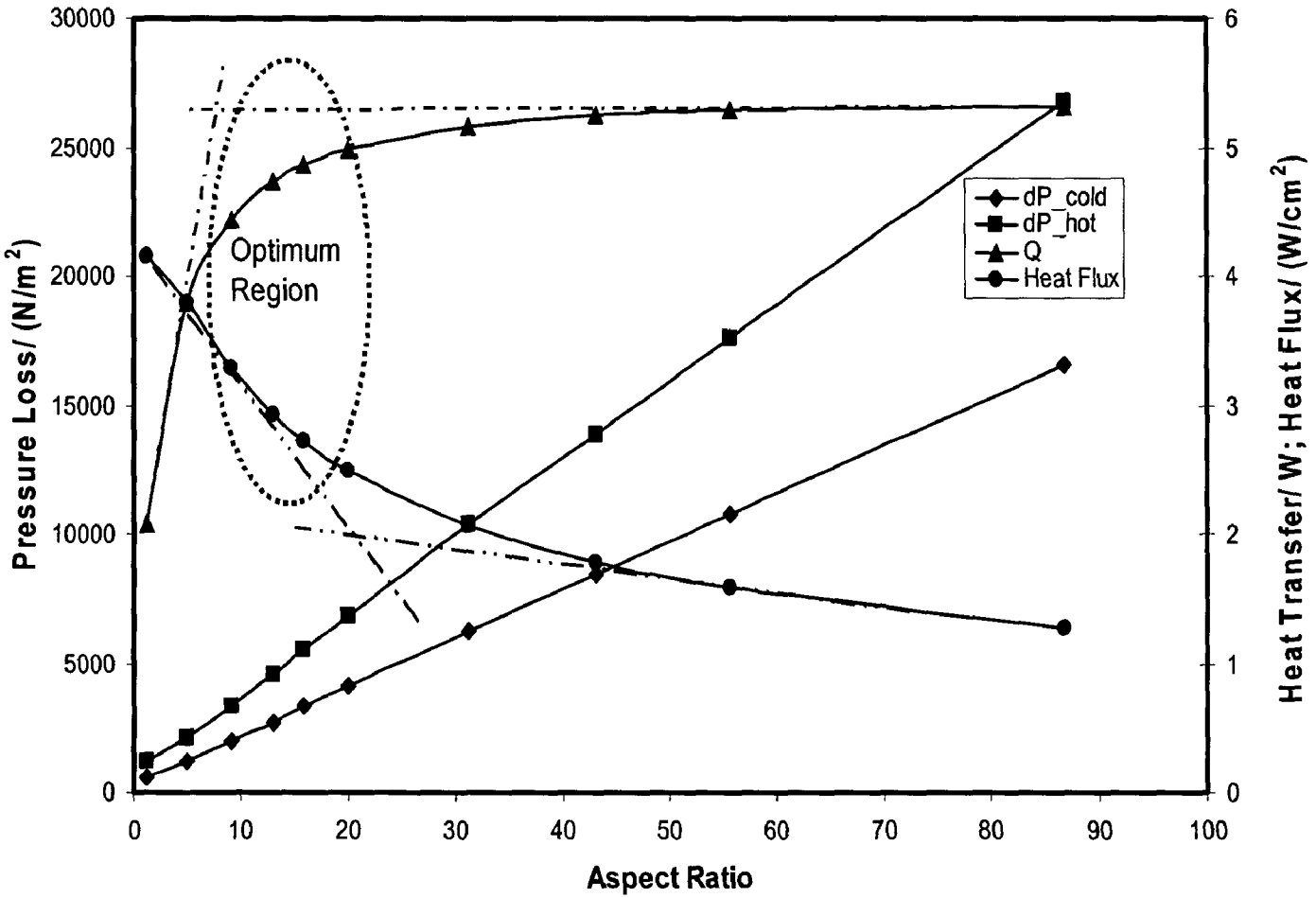
Figure 5C:
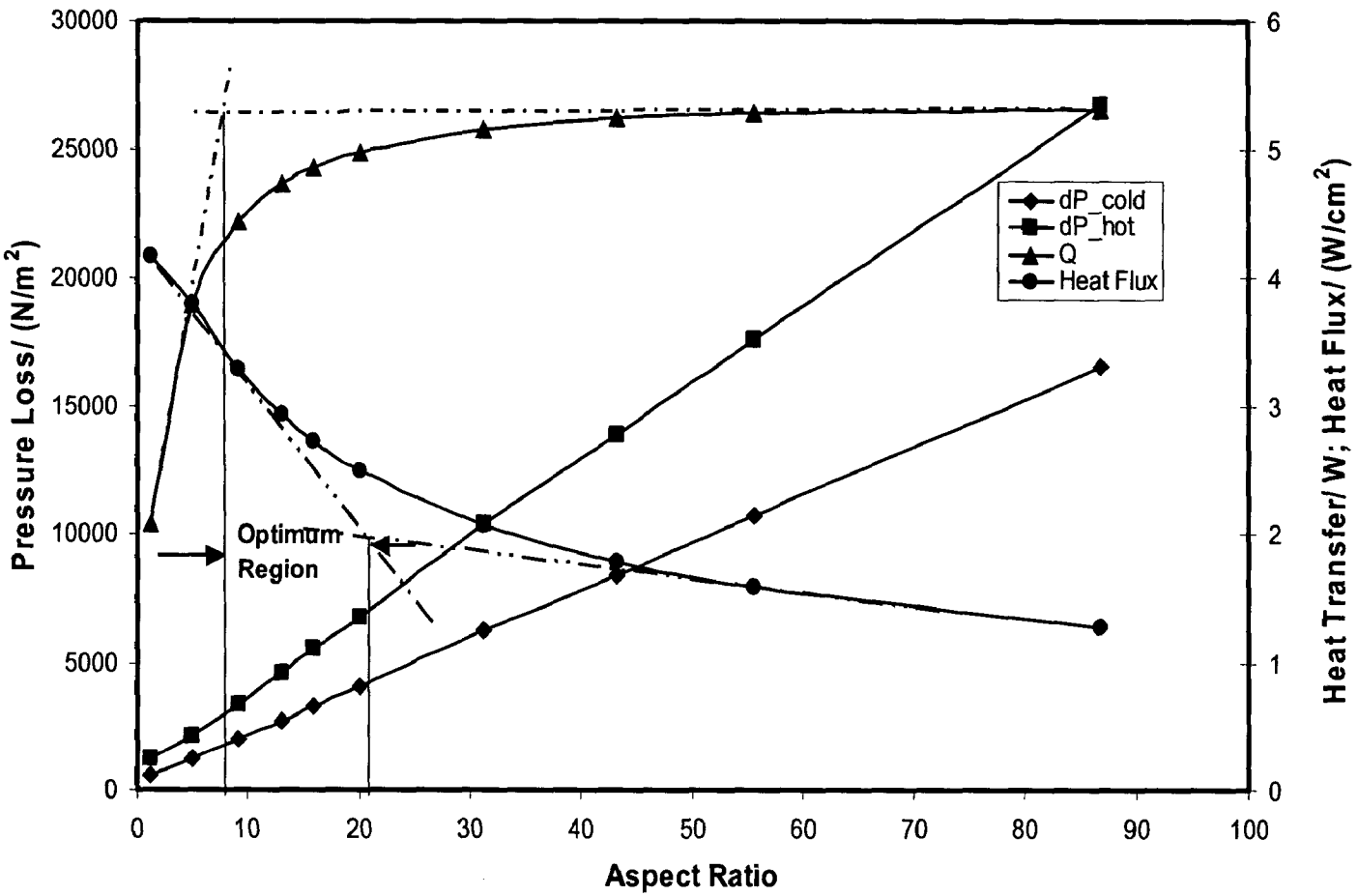

FIG. 5A, FIG. 5B, and FIG. 5C show the variation of heat flux, heat transfer rate and pressure drop in each channel with the aspect ratio, AR. It is clear from the plots shown in the figures that as the aspect ratio of the micro channel increases there is a rapid decrease in the heat flux coupled with a rapid increase in the pressure drop. Since the heat flux (and for that matter the heat transfer coefficient) and pressure loss have opposing trends there must be a balance between the two in choosing an optimal aspect ratio. The optimal aspect ratio lies in the optimal region which, in the various depictions shown in FIG. 5A, FIG. 5B, and FIG. 5C, is the region marked by the intersection of the tangents at the points' maximum and minimum curvature on the heat transfer rate and heat flux curves. This region is approximated by the area of the ellipse shown in FIG. 5A. To the left of the elliptical (optimum) region in FIG. 5A, even though the heat flux is high and pressure loss are low in the micro heat exchanger, by its very design, the heat transfer rate is low. On the other hand, the portion of the plotted curves to the right of the optimum region shows a very gradual increase in heat transfer with a correspondingly high pressure loss. No advantage is gained in designing the heat exchanger to operate in the zone to the right of the optimum region; accordingly, from the above results, for a given material and volume for a micro heat exchanger, the optimal dimensions of the channels may be obtained based on the choice of an optimal aspect ratio.

Table 3 shows examples of the micro channel dimensions based on aspect ratios within the marked optimum region. As mentioned earlier, these results were obtained based for fixed cross-sectional area and length (i.e., fixed volume) of micro channels.

TABLE 3

OPTIMAL DIMENSIONS OF MICRO CHANNELS

| Optimal Aspect Ratio | Optimal Height (mm) | Optimal Width (mm) |
|---|---|---|
| 9.1 | 3.38 | 0.37 |
| 13 | 4.03 | 0.31 |
| 15.9 | 4.46 | 0.28 |
| 20 | 5.00 | 0.25 |

EXAMPLE II B

In an alternative evaluation, the volume of the micro heat exchanger was allowed to vary, but was kept within the limits that define a micro heat exchanger (i.e., surface area density >10000 $m^2/m^3$). The flow rate of fluid (hot and cold) was kept constant for the different volumes of micro heat exchangers analyzed. Similar to Example II A, the length of the micro channels was fixed leaving the cross-sectional area as the variable. For the sake of simplicity the aspect ratio was varied by changing the height of micro channels but keeping the width constant at 0.25 mm. The material of the micro channels was again Inconel® with a thickness of 0.1 mm. Numerical simulations were performed by varying the aspect ratio of the micro channels in the range $5 \leqq AR \leqq 100$. The operating conditions of the micro heat exchanger are shown in Table 4.

Figure 6:
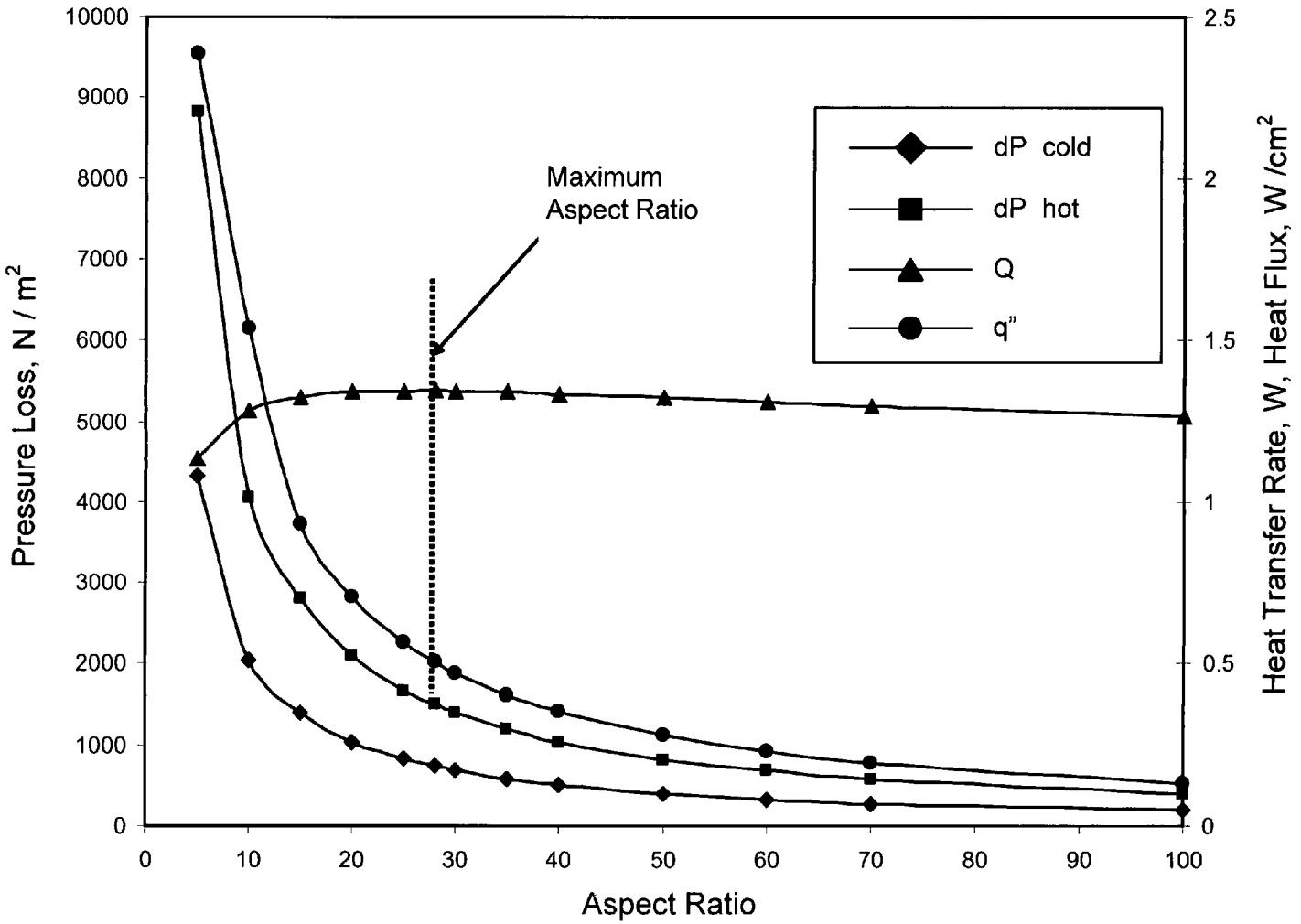
FIG. 6 is a chart showing the variation of the calculated parameters of pressure loss, heat transfer rate, and heat flux with channel aspect ratio in a situation where volume is variable and maximum aspect ratio is determined by the method of the invention.

FIG. 6 shows the variation of heat flux, heat transfer rate and pressure drop in each channel with the aspect ratio, AR. As the aspect ratio of the micro channel increases there is an associated increase in the heat transfer rate up to a maximum value after which the heat transfer rate decreases. For constant mass flow rate of fluid, a higher aspect ratio leads to lower fluid velocity. Also, the hydraulic diameter of the channel increases with aspect ratio. This increase in hydraulic diameter with aspect ratio combined with the attendant decrease in velocity leads to lower pressure drop in the channels as is shown in FIG. 4.

TABLE 4

| | Material | Flow rate per μ-channel (kg/sec) | Inlet Temperature (K) | Inlet pressure (bar) |
|---|---|---|---|---|
| Hot Gas | $N_2$ | 1.12e−5 | 1023 | 1.0 |
| Coolant | $CO_2$ | 6.0e−6 | 493 | 1.0 |

For the geometry under consideration shown in FIG. 4, increasing the channel aspect ratio increases the heat transfer area and consequently the transfer of heat. On the other hand, increasing the aspect ratio reduces the fluid velocity (and consequently the Reynolds number of the flow) thus leading to lower heat transfer coefficient. There are two competing factors contributing to the transfer of heat as the aspect ratio increases: 1) the increase in heat transfer area and 2) the corresponding decrease in heat transfer coefficient. A point is reached when the gain in heat transfer with increasing aspect ratio is offset by the loss caused by the decrease in convective heat transfer coefficient as a result of the lower velocity and hence Reynolds number. The effect gives rise to the graph of the heat transfer rate.

The broken line in FIG. 6 shows the (optimal) aspect ratio corresponding to the maximum heat transfer rate. The portion of FIG. 6 to the left of the maximum is characterized by high heat flux as well as high pressure loss. On the other hand, the portion to the right of the optimal aspect ratio shows a very gradual decrease in heat transfer whereas the aspect ratio and hence the volume of micro heat exchanger increases. It follows operating in the region to the right of the maximum point would tremendously reduce the energy density of a micro heat exchanger.

The graphs shown in FIG. 5A, FIG. 5B, FIG. 5C and FIG. 6 are case-specific; the designer of a micro heat exchanger must first determine (or define) the characteristic curves for the type of heat exchanger under consideration. Based on the characteristics and the design constraints, an optimal AR and, subsequently, the optimal dimensions may be obtained in accordance with the principles of the invention.

EXAMPLE II B, CONTINUED

In this example, the optimal geometric parameters of the channels of a micro heat exchanger are determined when the volume of the micro heat exchanger is not fixed by design considerations.

Associated with any given optimal aspect ratio, $AR_{opt}$, is an infinite number of pairs of channel height and width. The AR could therefore be viewed as a set populated by an infinite number of pairs of channel height and width.

$$AR_{opt}=\{(H_1, w_1), (H_2, w_2), \ldots, (H_n, w_n), \ldots\}.$$

The design objective is to determine the pair $(H_{opt}, w_{opt}) \epsilon AR_{opt}$ that gives the best performance of the micro heat exchanger. In calculating the optimal dimensions of the micro channel based on the chosen AR the analytical approach of Samalam is used. According to Samalam, for low aspect ratios, $AR \leqq 10$, the optimal dimensions of a micro channel are given by $$w_c = b \text{ and } w_s = H\sqrt{\frac{k_f Nu}{6k_s}} \text{ where } b^4 = \frac{12\mu k_f Nu l^2}{\rho c_p \Delta P}.$$

The above is valid for:

$$\frac{H}{b} \ll \pi^2\left[\frac{k_s}{6k_f Nu}\right]^{1/2}$$

For high aspect ratios, $$AR > 10,\ w_s = \frac{w_c}{2} \text{ and } w_c = \frac{2^{1/6}b^{4/3}}{\alpha^{1/6}H^{1/3}} \text{ where } \alpha = \frac{k_f Nu}{k_s}$$

The latter two equations are valid for the instance:

$$\frac{H}{b} \gg \frac{\pi^{0.75}}{(2\alpha)^{0.25}}.$$

Table 5 below sets out the steps calculating optimal geometric parameters in the continuation of Example II B:

TABLE 5

| $AR_{opt} \leqq 10$ | $AR_{opt} > 10$ |
|---|---|
| Determine Nu based on fluid properties<br>Fix allowable pressure loss ΔP<br>Decide on length of channels, l, based on space limitation,<br>Calculate b from the equation: | Determine Nu based on fluid properties<br>Fix allowable pressure loss ΔP<br>Decide on length of channels, l, based on space limitation.<br>Calculate b from the equation: |
| $b^4 = \frac{12\mu k_f Nu l^2}{\rho c_p \Delta P}$ | $b^4 = \frac{12\mu k_f Nu l^2}{\rho c_p \Delta P}$ |
| From the equation: | Calculate α from the equation: |
| $AR_{opt} = \{(H_1, w_1), (H_2, w_2), \ldots, (H_n, w_n), \ldots, w_c = b$ | $\alpha = \frac{k_f Nu}{k_s}$ |
| From $AR = \frac{H}{w_c}$, $H = w_c AR_{opt}$ | From $AR = \frac{H}{w_c}$ and $w_c = \frac{2^{1/6}b^{4/3}}{\alpha^{1/16}H^{1/3}}$ :<br>$w_c = \frac{2^{1/8}b}{\alpha^{1/8}AR_{opt}^{1/4}}$ |
| From the Equation $w_s = H\sqrt{\frac{k_f Nu}{6k_s}}$,<br>$w_s = w_c AR_{opt}\sqrt{\frac{k_f Nu}{6k_s}}$ | From $AR = \frac{H}{w_c}$ : $H = w_c AR_{opt}$ |
| Check the validity condition from the equation:<br>$\frac{H}{b} \ll \pi^2\left[\frac{k_s}{6k_f Nu}\right]^{1/2}$ | For high aspect ratios:<br>$\left(w_s = \frac{w_c}{2}\right)$<br>Check the validity condition from the equation:<br>$\frac{H}{b} \gg \frac{\pi^{0.75}}{(2\alpha)^{0.25}}$ |

Figure 7:
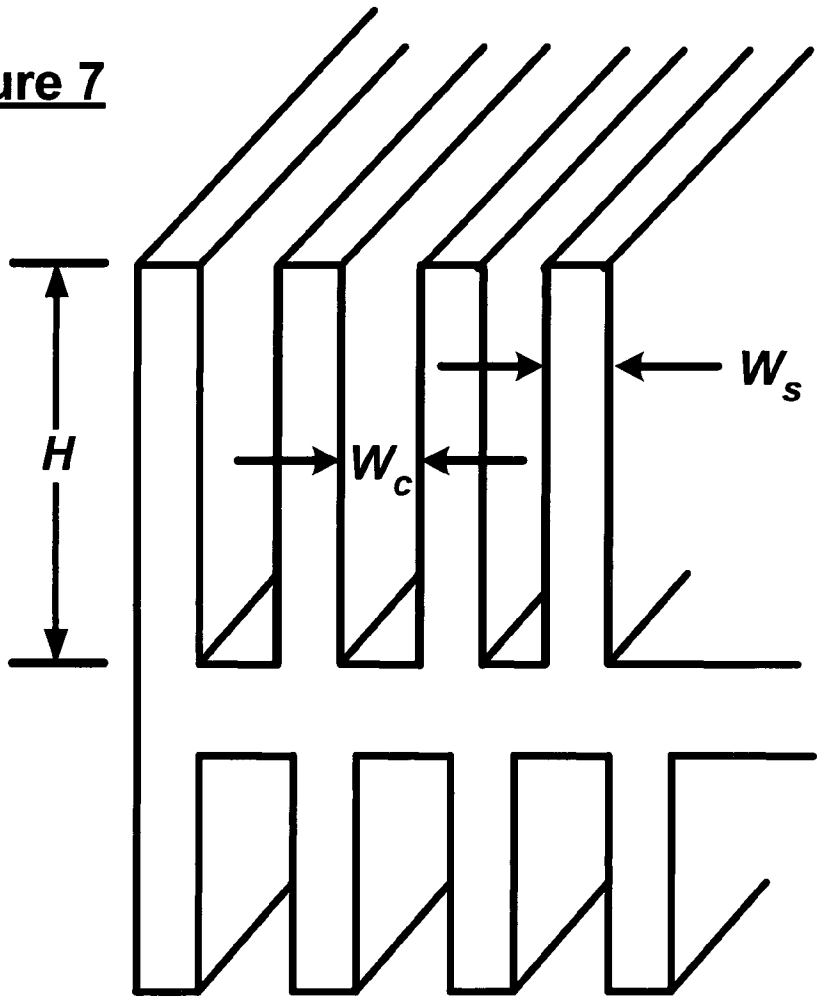
FIG. 7 illustrates a typical micro channel heat exchanger embodiment determined in accordance with the invention adapted to optimized compromise dimensions dictated by manufacturing requirements.

Table 5 demonstrates that a heat exchanger operating with two different fluids or with a same fluid will have different optimal dimensions for the channels transporting the hot and cold fluids. Whereas different optimal dimensions for a cold and a hot side are possible within micro heat exchangers of the type shown in FIG. 7, for the sake of simplicity of manufacture a compromise must be made in coming to the final dimensions in the case of the type of micro heat exchanger shown in FIG. 4.

EXAMPLE IV

For illustration purposes the optimal geometrical parameters of a micro heat exchanger based on the operating conditions in Table 3 are calculated. In FIG. 6, the optimal aspect ratio, $AR_{opt}$, corresponding to the maximum heat transfer rate was 28. The task of determining the optimal dimensions from the set of all possible pairs, (H, $w_c$), is accomplished by using equations (10) to (13) (for $AR_{opt}$>10). Using average fluid properties in the above equations led to the dimensions given in Table 6.

TABLE 6

| | Height of channel | Width of channel | Width of metal |
|---|---|---|---|
| Hot side | 14.8 | 0.53 | 0.26 |
| Cold side | 11.7 | 0.42 | 0.21 |

For the geometry under consideration it would not be feasible from a design point to have different dimensions for the hot-side and the cold-side micro channels. Further numerical simulations performed using each dimension for both channels produced better results with the cold-side dimensions.

Figure 8A:
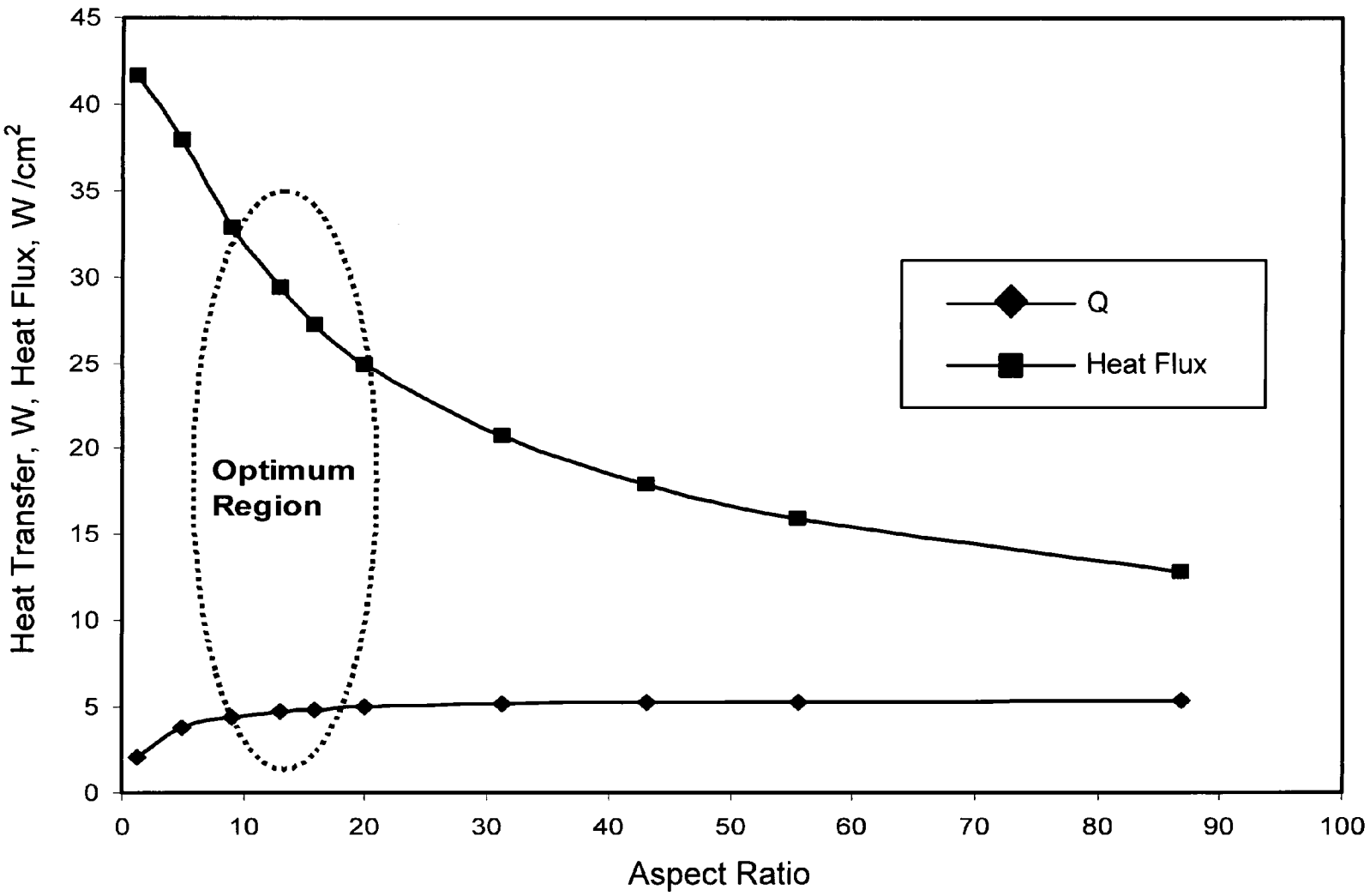
FIG. 8A and FIG. 8B are plot of heat transfer and heat flux in a constant volume application where plotted curves are based on a hypothetical micro heat exchanger that is an order of magnitude greater than that shown in FIG. 5A, FIG. 5B, FIG. 5C, and FIG. 6, a situation to which the method of the invention is similarly applicable.
Figure 8B:
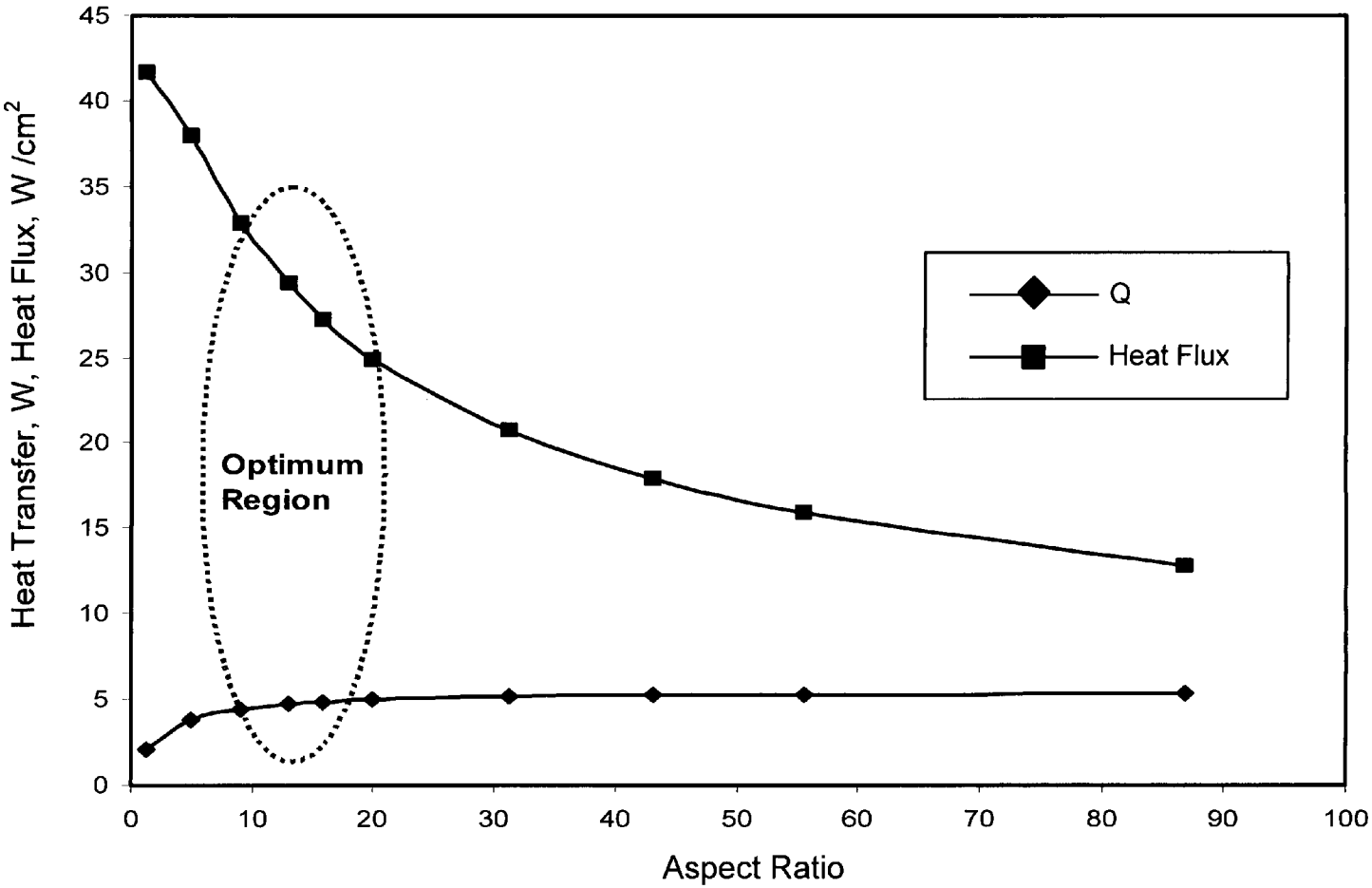

As set out above, the performance of micro heat exchangers depends on the operating conditions and aspect ratio of the micro channels. Using the techniques of the invention, the optimal dimensions of micro heat exchangers for a determined optimal aspect ratio may be calculated. In another embodiment, the chart of FIG. 8 shows a plot of heat transfer and heat flux in a constant volume application where plotted curves extend to a hypothetical order of magnitude greater, illustrating that the situation to which the method of the invention shown in FIG. 5A, FIG. 5B, FIG. 5C, and FIG. 6 is similarly adaptable to determine the range of preferred, and a specific, aspect ratio[s] for a micro channel device. In FIG. 8 and FIG. 8B, the heat flux, namely the ratio of the heat transfer rate to the heat transfer surface area, and surface area, was reduced by an order of magnitude (divide by 10) that shifted the two curves. The plot demonstrates that the method for determining the optimum region is applicable regardless of the position of the curves. Although four curves are not shown on the plot of FIG. 8, four parameters are shown in FIG. 5A, FIG. 5B, FIG. 5C and FIG. 6 because it is desirable to consider pressure loss in the channels within the optimum region. In addition to maximizing the heat flux (or heat transfer) within a channel, another desirable factor is to keep the pressure loss low.

In the applicability of the methods to a manufacturing process, given the predetermined requirements of space, volume, pressure, and system power, the optimized dimensions may be appropriately compromised to adapt to a defined manufacturing specification and other system or process requirements. Hence, in an industrial context, the methods disclosed herein provide a system for manufacturing a micro channel heat exchanger in which pre-determined parameters of maximum allowable pressure loss and the flow rate of hot fluid and cold fluid on the opposite sides of the channels are established and one or more of the channel height, channel width and the thickness of a solid material between channels is/are optimized in accordance with the methods described herein.

The optimized dimensions obtained in accordance with the methods and systems described above, are adapted to the requirements of a given manufacturing specification by compromising the calculated optimized dimensions to the requirements of a manufacturing design for the micro channel heat exchanger. In the compromising technique, for example, a predetermined pumping power may be a determinant of the maximum allowable pressure loss. Likewise, the determination of the maximum allowable pressure loss and the flow rate of hot fluid and cold fluid on the opposite sides of the channels may be a function of a predetermined length or other dimension established for the channels by manufacturing or design parameters; hence, other parameters will require adjustment when a given parameter is fixed by predetermined manufacturing requirements. Thus, the invention is directed as well to micro channel heat exchangers having channels with dimensions that are a result of a compromise of the optimum dimensions or ranges determined in accordance with the methods herein to adapt to the requirements of a predetermined manufacturing specification.

Having described the invention in detail, those skilled in the art will appreciate that, given the present disclosure, modifications may be made to the invention without departing from the spirit of the inventive concept herein described. Therefore, it is not intended that the scope of the invention be limited to the specific and preferred embodiments illustrations as described. Rather, it is intended that the scope of the invention be determined by the appended claims.

What is claimed is:

1. A micro channel heat exchanger for gaseous fluids, in which the micro channels have a surface area density greater than 10000 $m^2/m^3$ and a constant volume, the micro channels in the heat exchanger having an aspect ratio selected a priori by:

determining the thermal performance of the heat exchanger to obtain data with regard to a channel corresponding to heat transfer rate, velocity and flow;

plotting the performance curves of 1) pressure loss in the channel for the hot side; 2) pressure loss in the channel for the cold side; 3) heat flux; and 4) heat transfer rate against an axis corresponding to aspect ratio;

determining a range of aspect ratios based on the curves plotted in which the points on the aspect ratio axis corresponding to the intersections of the maximum and minimum of the gradients of the heat flux and heat transfer curves define the range and selecting an aspect ratio for the micro channel from the range of aspect ratios determined.

2. The heat exchanger of claim 1 wherein the thermal performance of the heat exchanger is determined in accordance with the formulae:

$$\frac{\partial}{\partial x_i}(\rho u_i) = 0;$$

$$\rho u_j \frac{\partial u_i}{\partial x_j} = -\frac{\partial p}{\partial x_i} + \rho g_i \frac{\partial \tau_{ij}}{\partial x_j}$$

where $$\tau_{ij} = \mu\left(\frac{\partial u_i}{\partial x_j} + \frac{\partial u_j}{\partial x_i}\right) + \left(\beta - \frac{2}{3}\mu\right)\frac{\partial u_k}{\partial x_k}\delta_{ij};$$

and $$\rho u_i \frac{\partial h}{\partial x_i} = \frac{\partial p}{\partial t} + u_i \frac{\partial p}{\partial x_i} + \phi + \frac{\partial}{\partial x_i}\left(k\frac{\partial T}{\partial x_i}\right) \text{ where } \phi = \tau_{ij}\frac{\partial u_i}{\partial x_j}.$$

3. A micro channel heat exchanger for gaseous fluids in which the micro channels have a surface area density greater than 10000 $m^2/m^3$ and the design specifications for the volume of the channels are variable and require an aspect ratio less than or equal to 10, wherein the aspect ratio of the micro channels is determined a priori by:

determining the thermal performance of the heat exchanger to obtain data with regard to a channel corresponding to heat transfer rate, velocity and flow;

plotting the performance curves of 1) pressure loss in the channel for the hot side; 2) pressure loss in the channel for the cold side; 3) heat flux; and 4) heat transfer rate against an axis corresponding to aspect ratio;

determining a range of aspect ratios based on the curves plotted in which the points on the aspect ratio axis corresponding to the intersections of the maximum and minimum of the gradients of the heat flux and heat transfer curves define the range; and from the range, determining the dimensions of the micro channels in accordance with the steps of determining Nu based on fluid properties;

fixing an allowable pressure loss $\Delta P$;

predetermining a channel length, l, for a given space;

calculating b from the equation:

$$b^4 = \frac{12\mu k_f Nul^2}{\rho c_p \Delta P};$$

determining $AR_{opt} = \{(H_1, w_1), (H_2, w_2), \ldots, (H_n, w_n), \ldots\}$, $w_c = b$;

determining $AR = \frac{H}{w_c}$, $H = w_c AR_{opt}$; and determining $w_s = H\sqrt{\frac{k_f Nu}{6k_s}}$, $w_s = w_c AR_{opt}\sqrt{\frac{k_f Nu}{6k_s}}$.

4. The heat exchanger of claim 3 in which the thermal performance of the heat exchanger is determined in accordance with the formulae:

$$\frac{\partial}{\partial x_i}(\rho u_i) = 0;$$

$$\rho u_j \frac{\partial u_i}{\partial x_j} = -\frac{\partial p}{\partial x_i} + \rho g_i \frac{\partial \tau_{ij}}{\partial x_j}$$

where $$\tau_{ij} = \mu\left(\frac{\partial u_i}{\partial x_j} + \frac{\partial u_j}{\partial x_i}\right) + \left(\beta - \frac{2}{3}\mu\right)\frac{\partial u_k}{\partial x_k}\delta_{ij};$$

and $$\rho u_i \frac{\partial h}{\partial x_i} = \frac{\partial p}{\partial t} + u_i \frac{\partial p}{\partial x_i} + \phi + \frac{\partial}{\partial x_i}\left(k\frac{\partial T}{\partial x_i}\right) \text{ where } \phi = \tau_{ij}\frac{\partial u_i}{\partial x_j}.$$

5. The heat exchanger of claim 3 in which the validity of the dimensions determined is verified by application of the formula:

$$\frac{H}{b} \ll \pi^2\left[\frac{k_s}{6k_f Nu}\right]^{1/2}.$$

6. In a method for establishing a manufacturing design for a micro component heat exchange for gaseous fluids, determining a priori the aspect ratio of the micro channels in the heat exchanger wherein the micro channels have a surface area density greater than 10000 $m^2/m^3$ and the design specifications for the volume of the channels are variable and require an aspect ratio greater than 10, comprising:

determining the thermal performance of the heat exchanger to obtain data with regard to a channel corresponding to heat transfer rate, velocity and flow;

plotting the performance curves of 1) pressure loss in the channel for the hot side; 2) pressure loss in the channel for the cold side; 3) heat flux; and 4) heat transfer rate against an axis corresponding to aspect ratio;

determining a range of aspect ratios based on the curves plotted in which the points on the aspect ratio axis corresponding to the intersections of the maximum and minimum of the gradients of the heat flux and heat transfer curves define the range; and from the range, determining the dimensions of the micro channels in accordance with the steps of, determining Nu based on fluid properties;

fixing an allowable pressure loss ΔP;

predetermining a channel length, l, for a given space;

calculating b from the equation:

$$b^4 = \frac{12\mu k_f Nul^2}{\rho c_p \Delta P};$$

calculating α from the equation:

$$\alpha = \frac{k_f Nu}{k_s};$$

determining $AR = \frac{H}{w_c}$ and $$w_c = \frac{2^{1/6} b^{4/3}}{\alpha^{1/6} H^{1/3}};\ w_c = \frac{2^{1/18} b}{\alpha^{1/8} AR_{opt}^{1/4}}; \text{ and}$$

determining $AR = \frac{H}{w_c}$: $H = w_c AR_{opt}$.

7. The method of claim 6 wherein the thermal performance of the heat exchanger is determined in accordance with the formulae:

$$\frac{\partial}{\partial x_i}(\rho u_i) = 0;$$

$$\rho u_j \frac{\partial u_i}{\partial x_j} = -\frac{\partial p}{\partial x_i} + \rho g_i + \frac{\partial \tau_{ij}}{\partial x_j} \text{ where}$$

$$\tau_{ij} = \mu\left(\frac{\partial u_i}{\partial x_j} + \frac{\partial u_j}{\partial x_i}\right) + \left(\beta - \frac{2}{3}\mu\right)\frac{\partial u_k}{\partial x_k}\delta_{ij}; \text{ and}$$

$$\rho u_i = \frac{\partial h}{\partial x_i} = \frac{\partial p}{\partial t} + u_i \frac{\partial p}{\partial x_i} + \phi + \frac{\partial}{\partial x_i}\left(k\frac{\partial T}{\partial x_i}\right) \text{ where}$$

$$\phi = \tau_{ij}\frac{\partial u_i}{\partial x_j}.$$

8. The method of claim 6 wherein the validity of the dimensions determined is verified by application of the formula:

$$\frac{H}{b} \gg \frac{\pi^{0.75}}{(2\alpha)^{0.25}}.$$

9. A manufactured micro channel heat exchanger having a predetermined maximum allowable pressure loss and flow rate of hot fluid and cold fluid on the opposite sides of the channels wherein the channel height, channel width and the thickness of a solid material between the channels is in accordance with claim 1 or claim 2 or claim 3 or claim 4 or claim 5 or claim 6 or claim 7 or claim 8 wherein the dimensions obtained in optimizing to the requirements of a given manufacturing specification are determined by compromising the optimized dimensions to the requirements of a manufacturing design for the micro channel heat exchanger.

10. A heat exchanger of claim 9 wherein a predetermined pumping power is a determinant of the maximum allowable pressure loss.

11. A heat exchanger of claim 9 wherein the maximum allowable pressure loss and the flow rate of hot fluid and cold fluid on the opposite sides of the channels is a function of one or more predetermined dimension established for the channels.

12. The heat exchanger of claim 11 wherein the predetermined dimension established for the channels is length.

* * * * *